US006016914A

United States Patent [19]

Gustafson

[11] Patent Number: 6,016,914

[45] Date of Patent: Jan. 25, 2000

[54] BLISTER PACKAGE WITH RECLOSABLE CARD

[75] Inventor: Arthur L. Gustafson, St. Charles, Ill.

[73] Assignee: Algus Packaging Inc., Dekalb, Ill.

[21] Appl. No.: 09/266,405

[22] Filed: Mar. 10, 1999

[51] Int. Cl.[7] ..... B65D 73/00

[52] U.S. Cl. ..... 206/470; 206/461; 206/467

[58] Field of Search ..... 206/461, 464, 206/467, 469, 470

[56] References Cited

U.S. PATENT DOCUMENTS

| | | | |
|---|---|---|---|
| 3,685,648 | 8/1972 | Heller . | |
| 4,133,429 | 1/1979 | Kuchenbecker . | |
| 4,166,535 | 9/1979 | Gilling . | |
| 4,191,293 | 3/1980 | Newman . | |
| 4,200,193 | 4/1980 | Boyle . | |
| 4,202,464 | 5/1980 | Mohs . | |
| 4,209,095 | 6/1980 | Dutcher . | |
| 4,210,246 | 7/1980 | Kuchenbecker . | |
| 4,236,636 | 12/1980 | Kuchenbecker . | |
| 4,300,682 | 11/1981 | Kuchenbecker | 206/461 |
| 4,496,052 | 1/1985 | Nertman . | |
| 4,569,442 | 2/1986 | Bushey . | |
| 4,574,951 | 3/1986 | Weaver . | |
| 4,739,883 | 4/1988 | Mohs . | |
| 4,938,462 | 7/1990 | Gould . | |
| 5,154,293 | 10/1992 | Gould | 206/461 |
| 5,209,354 | 5/1993 | Thornhill . | |
| 5,297,679 | 3/1994 | Rondone et al. | 206/467 |
| 5,353,935 | 10/1994 | Yeager . | |
| 5,407,070 | 4/1995 | Bascos et al. | 206/467 |
| 5,579,910 | 12/1996 | Bennett . | |
| 5,819,939 | 10/1998 | Boyer | 206/461 |

*Primary Examiner*—David T. Fidei
*Attorney, Agent, or Firm*—Keith Frantz

[57] ABSTRACT

A front blister is formed with a forwardly extending bubble and a slot extending downwardly in an edge portion above the bubble. A backing card formed with upper, center and lower portions, is attached to the back of the blister at the upper and lower portions to close the back of the bubble. The center portion of the card comprises a closure panel, pivotable between an open position providing access to contents in the bubble and a closed position, and a locking tab extending upwardly therefrom, the locking tab being positioned for folding into and out of the slot and sized for an interference fit with the slot to releasably maintain the panel in a closed position. To initially open the package, the center portion is separated from the upper portion of the card along perforation lines formed in the card, and is pivoted away from the blister about a fold line at the junction with the lower portion of the card.

6 Claims, 4 Drawing Sheets

BLISTER PACKAGE WITH RECLOSABLE CARD

BACKGROUND OF THE INVENTION 1. Field of Invention

The present invention relates generally to packaging, and more specifically, to recloseable blister packaging.

2. Description of Prior Art

Use of blister packages is a convenient method for displaying merchandise in retail stores. A typical blister package includes a thermoformed thermoplastic blister formed with a bubble for receiving articles of merchandise, and a back connected to the blister to close the bubble and retain the merchandise in the package.

When used to display a quantity of relatively small articles such as screws, nuts, bolts, fuses, rivets and the like, it is desirable to use a recloseable blister package. This allows the package to serve as a recloseable storage container for the merchandise, as well as to display the merchandise.

One prior method of making a recloseable blister package is to thermoform the front blister and the back closure member from a single sheet of plastic, with an integral hinge formed between the front and back for opening and closing of the package, and with integral interlocking flanges or other complimentary male/female closure arrangements to provide for releasable closure of the package. Examples of such arrangements are shown in Shields, U.S. Pat. No. 4,499,353 and Harding, U.S. Pat. No. 4,512,474. The cost to make tooling for thermoforming plastic parts is, in general, relatively expensive, and as the complexity of the formed part increases, so does the initial tooling costs. Thus, the tooling necessary to form such complicated reclosable blister package arrangements is relatively expensive.

Another common technique for constructing reclosable blister packages is to use a plastic blister with a paperboard or card stock back provided with a reclosable panel. Such an arrangement is desirable because (1) the tooling required to cut the back from a sheet of flat stock is typically less expensive than the tooling necessary to thermoform the back from plastic, and (2) although flat paperboard, card stock and flat plastic may be used interchangeably, paperboard and card stock are typically less expensive than plastic, and product or merchandising information is more easily printed on paperboard or card stock than on plastic. However, a disadvantage of paperboard and card stock is that they tend to be less durable than plastic, and are prone to deformation if bent, or spreading as plies of a multi-ply paperboard tend to separate after repeated opening and closing of the package.

Several reclosable blister packages with paperboard backs are known in the prior art. Unfortunately, many prior package arrangements tend to lose their ability to remain closed, after being opened and closed several times, as a result of deformation or separation of the back in the area of interlocking engagement, as well as suffering from other undesirable characteristics.

Kuchenbecker, U.S. Pat. No. 4,210,246 and U.S. Pat. No. 4,236,636 utilize a blister provided with a plastic tab having ears that must be bent to slip through a cut-out in the paperboard back, and that must engage the back surfaces surrounding the cut-out for interlocking between the blister and the back.

The arrangement of Nertman, U.S. Pat. No. 4,496,052 is especially sensitive to wear, utilizing a plastic blister formed with projections having a shaped profile and circular cross-section to interlock into holes formed in the back.

Yeager, U.S. Pat. No. 5,353,935 teaches use of a plastic blister formed with detents to overlap and retain the paperboard back in the closed position. In this instance, the back becomes increasingly difficult to press into the relatively narrow space between the detents and the back of the blister for closing of the package as the associated edges of the back deform from repeated use.

Dutcher, U.S. Pat. No. 4,209,095 relies on relatively narrow interlocking edges of the paperboard back to effect re-closure of the package. These edges are sheared from the paperboard back when the package is initially opened, and careless or improper initial opening will not generate the desired edges, resulting in loss of the ability to properly re-close the package.

Boyle, U.S. Pat. No. 4,200,193 utilizes a tab formed in the paperboard back for positioning into an overlapping, substantially parallel relationship with an edge of the blister to effect closure of the package. Unfortunately, if this package is oriented with its back facing downwardly, the weight of articles in the blister will cause an "opening" torque on the tab and pivot the tab back over the edge of the blister.

Thus, it is clear that there is a need for a reclosable blister package having an improved, yet relatively simple and cost-effective interlocking arrangement between a thermoformed plastic blister and a paperboard back.

SUMMARY OF THE INVENTION

The general aim of the present invention is to provide a reclosable blister package having a new and improved releasable, interlocking arrangement between a front blister and a paperboard back, such arrangement being relatively simple, yet reliable and economical to manufacture.

A detailed objective is to achieve the foregoing by providing a blister formed with a slot, and a back closure panel formed with a tab positioned for simply folding into and out of the slot and sized for an interference fit with the slot for releasably maintaining the panel in a closed position.

These and other objectives and advantages of the invention will become more apparent from the following detailed description when taken in conjunction with the accompanying drawings.

Briefly, a reclosable blister package according to the invention includes (1) a thermoformed blister formed with a forwardly extending bubble and a downwardly extending slot in an edge portion above the bubble, and (2) a backing card formed with a closure panel pivotable between open and closed positions, and a locking tab adapted to fold into and out of the slot and sized for an interference fit with the slot for releasably maintaining the panel in the closed position. The card is formed with upper, center and lower portions, and is attached to the back of the blister at the upper and lower portions to close the back of the bubble. To initially open the package, the center portion, comprising the closure panel and locking tab, is separated from the upper portion along perforation lines formed in the card, and pivoted downwardly and away from the blister about a fold line at the junction with the lower portion of the card. With the center panel returned the closed position, the tab is folded into the slot along a second fold line coincident with the bottom of the slot to maintain the panel in the closed position. The package may then be re-opened by simply unfolding the tab out of the slot, and re-closed by pressing the tab back into the slot.

Figure 1:
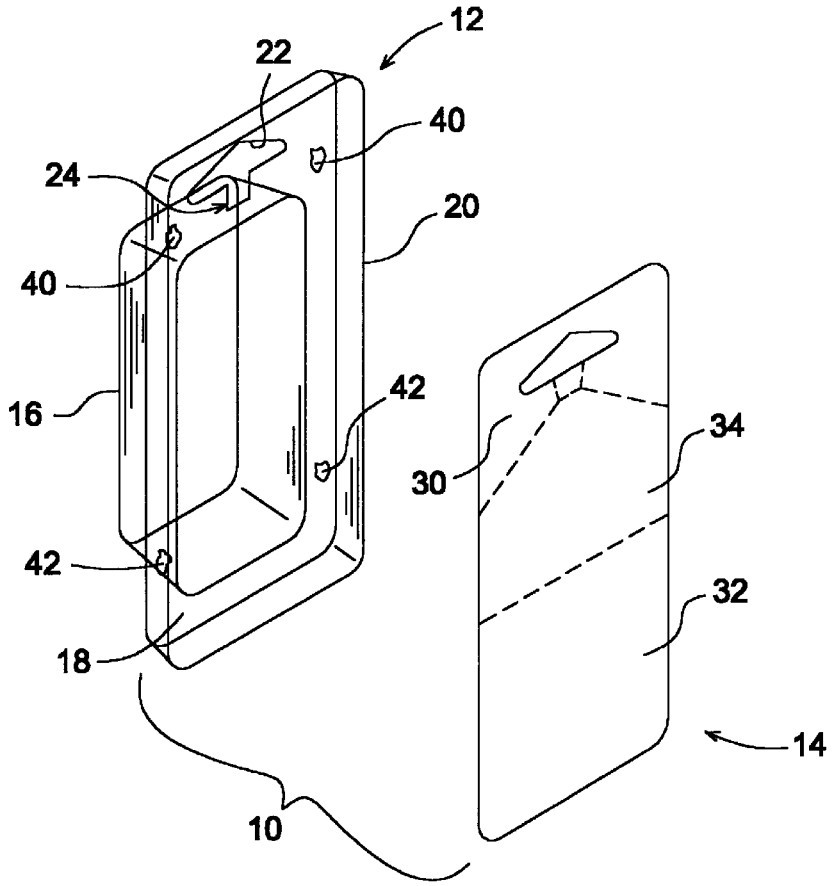
FIG. 1 is an exploded rear perspective view of a new and improved reclosable blister package comprising a front blister and a back closure card, and incorporating the unique aspects of the present invention.
Figure 2A:
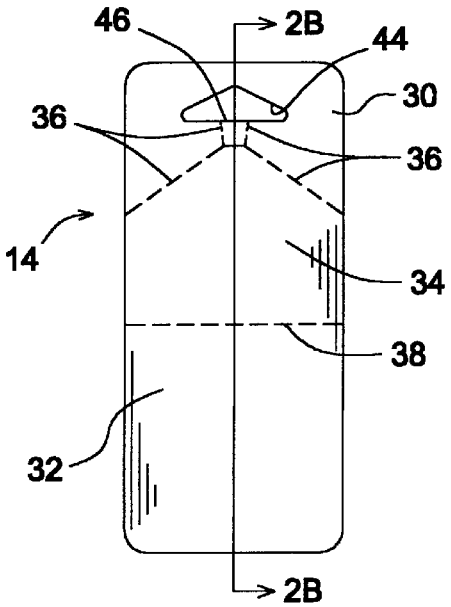
FIGS. 2A and 2B are rear and side views, respectively, of the back closure card, a blister access panel and locking tab being shown in FIG. 2A between the dashed lines.
Figure 2B:
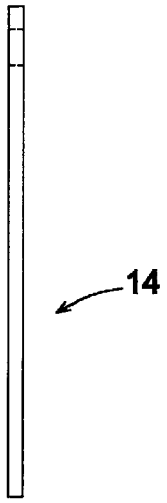

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings in connection with a recloseable blister package 10 suitable for storing and displaying articles of merchandise (not shown) such as screws, nuts, fuses, or other relatively small articles, on hooks, pegs or hangers (not shown).

In general, the package 10 includes a front blister 12 and a backing card 14. The blister is thermoformed from thermoplastic according to well known processes and materials, and is formed with a forwardly extending bubble 16, a back wall 18 generally surrounding the bubble, and a rearwardly extending skirt 20 surrounding the perimeter of the back wall. Formed in the upper portion of the back wall is an opening 22 suitable for receiving a hook or hanger for suspension of the package therefrom, and a slot 24, extending downwardly from a lower edge portion of the opening 22, the slot being defined by sides 26 and a base 28.

The card 14 is cut from sheet material suitable to carry out the present invention, and preferably from relatively stiff multi-ply paperboard or card stock. The card is initially formed with upper and lower portions, 30 and 32, respectively, and a center portion 34, with spaced perforation lines 36 separating the upper and center portions, and a fold line 38 separating the center and lower portions. During assembly of the package, after articles have been placed in the bubble, the upper and lower portions of the card are securely connected to the back wall 18 of the blister 12, such as generally designated at 40 and 42, respectively, with, for example, heat-activated or other suitable adhesive, to close the back of the bubble. The skirt 20 generally surrounds the edges of the card to protect it from catching on other objects.

Figure 3:
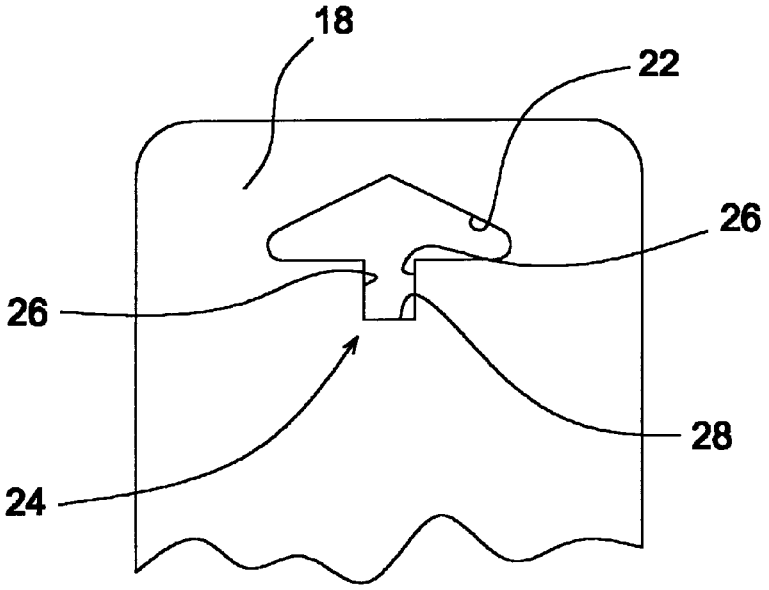
FIGS. 3 and 4 are enlarged views of the slot of the blister and the locking tab of the card, respectively.
Figure 4:
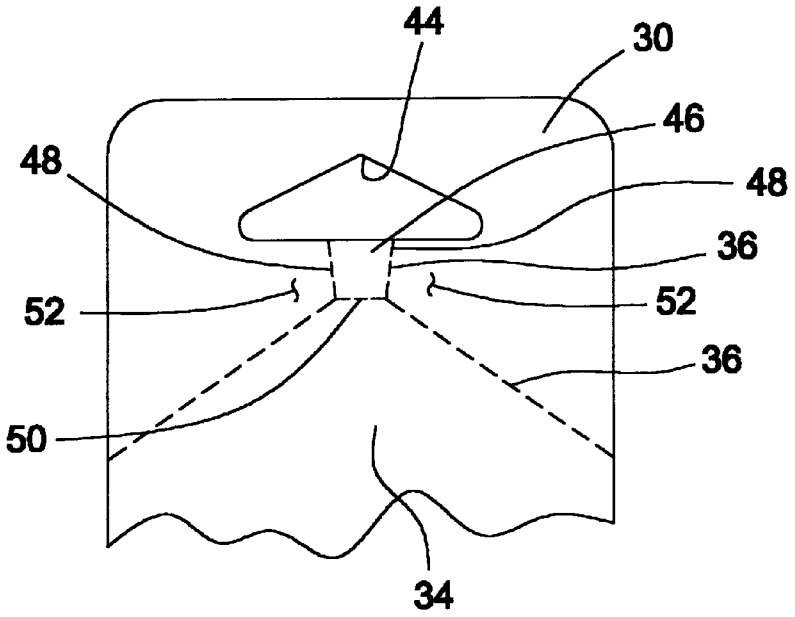

The upper portion of the card 14 includes an opening 44 generally coincident with opening 22 when the card is in position on the back 18 of the blister 12. The perforations lines 36 extend inwardly from the sides of the card, and then turn upwardly, preferably coincident with the base 28 of the slot 24, terminating in spaced relation at the lower edge of the opening 44 to define a tab 46 therebetween, with sides 48 of the tab defined at the inside edges of the upper legs of perforations 36. A second fold line 50 is formed in the card between the perforation lines 36 to define the base of the tab 46. Preferably, the fold line 50 is coincident with the base 28 of the slot 24 in the blister 12, and the sides 48 of the tab 46 extend outwardly with respect to the sides 26 of the slot 24 upon progressing upwardly from the fold line 50, with the center portion adjacent the back of the blister. In the preferred embodiment shown, and as best seen in FIGS. 3 and 4, the slot 24 is formed with substantially parallel sides 26, and the tab is formed with sides 48 that extend at an angle with respect to the sides 26 of the slot for an increasingly overlapping condition between the sides 48 of the tab and the sides 26 of the slot.

Figure 5:
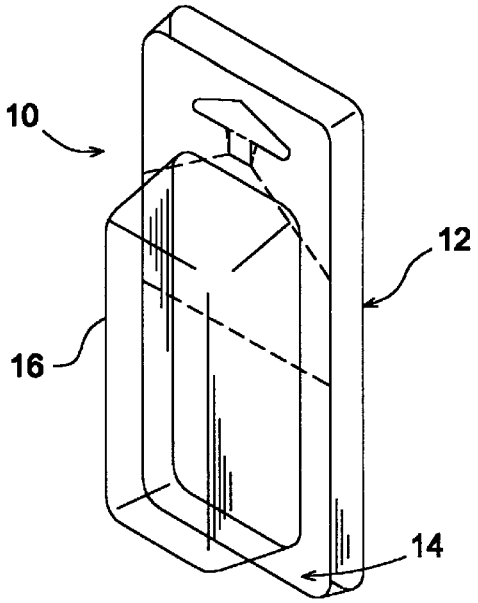
FIG. 5 is a front perspective view of the package showing the tab and access panel as initially assembled and prior to the initial opening of the package.
Figure 6:
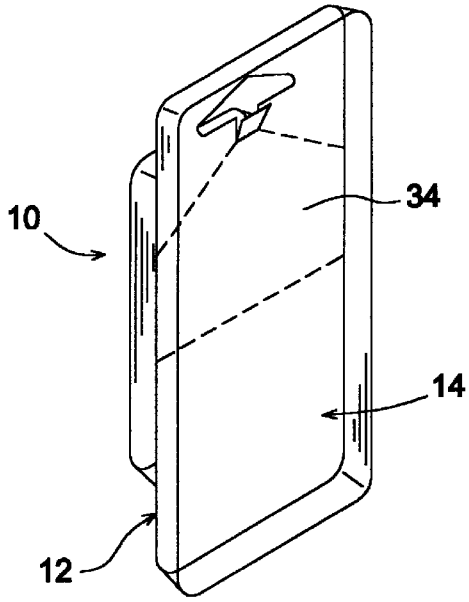
FIG. 6 is a rear perspective view showing the locking tab separated from the card and folded rearwardly from the blister, with the access panel shown closed.
Figure 7:
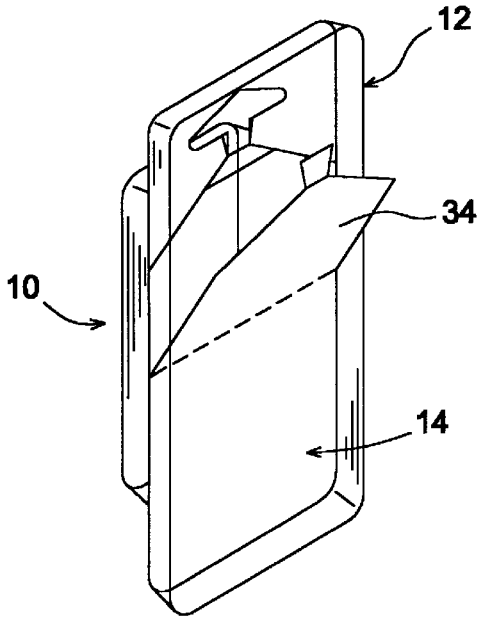
FIG. 7 is a rear perspective view showing the access panel separated from the card and in an open position for access to contents of the package.
Figure 8:
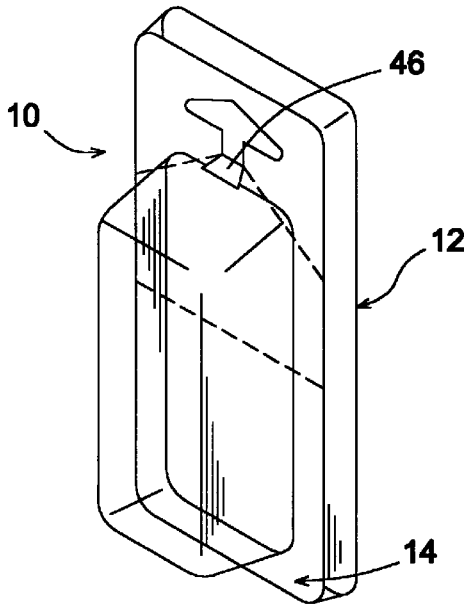
FIG. 8 is a front perspective view showing the access panel returned to the closed position and the locking tab extending forwardly and interlocking with the slot in for maintaining the package closed.
Figure 9:
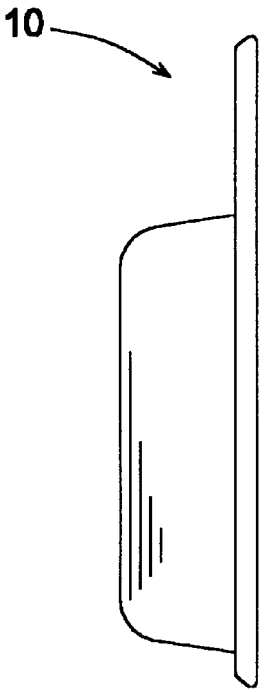
FIGS. 9–12 are sides views of the package showing the positions of the tab and access panel generally corresponding with FIGS. 5–8, respectively.
Figure 10:
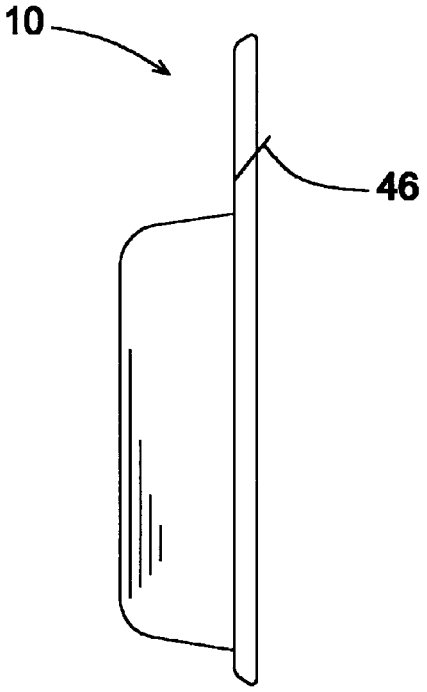
Figure 11:
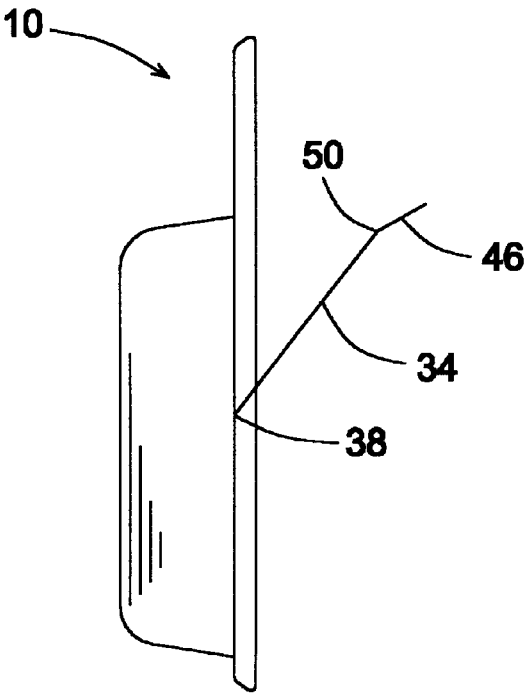
Figure 12:
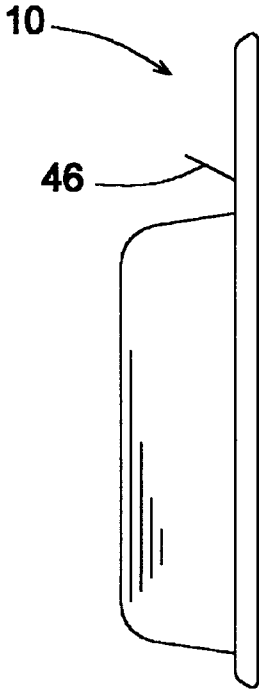

An initially assembled package, with the card closing the back of the bubble, and the perforation lines "in tact" is shown in FIGS. 5 and 9. The package is initially opened by pulling the tab rearwardly and downwardly about the fold line 50 to separate the tab from the upper portion 30 of the card 14 along the upper legs of the perforation lines 36 as generally shown in FIGS. 6 and 10. With the tab bent away from the package, pulling rearwardly and downwardly on the tab causes the center panel 34 to separate from the upper portion of the card along the remainder (i.e., the lower legs) of the perforation lines 36, and pivot about fold line 38, providing access to the articles in the bubble as indicated in FIGS. 7 and 11. The package may be re-closed by returning the center portion of the card to its initial position against the back wall 18 of the blister, and bending the tab forward and down past the sides 26 of the slot 24. The package of course can be re-opened and re-closed by simply pulling the tab out of and pressing the tab into engagement with the slot.

From the foregoing, it is clear that the cooperating tab 46 and slot 24 provide a reliable, yet relatively and economical to manufacture, arrangement for easy opening and closing of the package 10, the interference fit between the tab and the slot providing positive frictional interlocking that is not substantially effected after repeated opening and closing of the package to maintain the center panel 34 in the closed position. Advantageously, the edge portions 52 (FIG. 4) of the card provide additional stiffness to resist rearward flexing of the sides 26 of the slot 24. Although this additional resistance is easily overcome when the tab is manually pressed through the slot, the added stiffness assists in prevent inadvertent opening of the package.

I claim:

1. A recloseable package comprising:

a thermoformed plastic blister having:

a bubble extending forwardly and opening rearwardly, and a back wall surrounding the bubble, the back wall having top and bottom portions, said top portion being formed with a downwardly extending slot; and a backing card having:

upper, center and lower portions, said upper and lower portions being connected to the top and bottom portions, respectively, of said back wall, and said center portion being aligned with said bubble, first and second perforations separating the upper and center portions, said perforations being spaced to define a tab therebetween, said tab extending upwardly from said center portion and being aligned with said slot, a first fold line separating the center and lower portions for pivoting of said center portion when separated from said upper portion along said perforations between an open position for access to the inside of the bubble and a closed position adjacent said back wall and closing the back of said bubble, and a second fold line separating said center portion and said tab for pivoting of said tab between a free position rearwardly of the back wall and an engaged position extending through said slot, said tab being sized for an interference fit with said slot for retaining the center portion in said closed position when said tab is pressed through said slot.

2. A package as defined in claim 1 in which said slot is formed with parallel sides, and said tab includes sides formed at an acute angle with respect to associate sides of the slot for an increasing overlapping interference fit upon progressing upwardly from said second fold line.

3. A package as defined in claim 1 in which said second fold line is substantially coincident with the base of said slot.

4. A recloseable package comprising:

a thermoformed plastic blister having:

a bubble extending forwardly and opening rearwardly, and a back wall surrounding the bubble, the back wall having top and bottom portions, said top portion being formed with:

an opening, and a slot extending downwardly from said opening; and a backing card having:

upper, center and lower portions, and opposing side portions, said upper and lower portions being connected to the top and bottom portions, respectively, of said back wall proximate said side portions, said center portion being aligned with said bubble, first and second perforations extending inwardly from said side portions and then upwardly toward said opening for separating the upper and center portions, said perforations being spaced to define a tab aligned with said slot and extending upwardly from said center portion to proximate said opening, a first fold line extending between said side portions and separating the center and lower portions for pivoting of said center portion when separated from said upper portion along said perforations between an open position for access to the inside of the bubble and a closed position adjacent said back wall and closing the back of said bubble, and a second fold line extending laterally between said perforations and separating said center portion and said tab for pivoting of said tab between a free position rearwardly of the back wall and an engaged position extending through said slot, said tab being sized for an interference fit with said slot for retaining the center portion in said closed position when said tab is pressed through said slot.

5. A package as defined in claim 4 in which said slot is formed with parallel sides, and said tab includes sides formed at an acute angle with respect to associate sides of the slot for an increasing overlapping interference fit upon progressing upwardly from said second fold line.

6. A package as defined in claim 4 in which said second fold line is substantially coincident with the base of said slot.

* * * * *